US007317393B2

(12) United States Patent
Maloney

(10) Patent No.: US 7,317,393 B2
(45) Date of Patent: Jan. 8, 2008

(54) OBJECT TRACKING METHOD AND SYSTEM WITH OBJECT IDENTIFICATION AND VERIFICATION

(75) Inventor: William C. Maloney, Atlanta, GA (US)

(73) Assignee: Key Control Holding, Inc., Houston, TX (US)

( * ) Notice: Subject to any disclaimer, the term of this patent is extended or adjusted under 35 U.S.C. 154(b) by 260 days.

(21) Appl. No.: 10/719,354

(22) Filed: Nov. 21, 2003

(65) Prior Publication Data

US 2004/0113786 A1 Jun. 17, 2004

Related U.S. Application Data

(63) Continuation of application No. 10/180,665, filed on Jun. 26, 2002, now Pat. No. 6,707,381.

(60) Provisional application No. 60/300,988, filed on Jun. 26, 2001.

(51) Int. Cl.
*G08B 13/14* (2006.01)

(52) U.S. Cl. ..... 340/568.1; 340/568.2; 340/670

(58) Field of Classification Search ..... 340/539.12, 340/568.1, 568.2, 570, 572.1, 572.4, 572.6, 340/10.34, 825.49; 232/43.1, 44; 128/897, 128/898; 700/231, 232, 233, 236, 237, 241; 194/212, 213

See application file for complete search history.

(56) References Cited

U.S. PATENT DOCUMENTS

| | | | | |
|---|---|---|---|---|
| 527,589 | A | 10/1894 | Bristol | 312/212 |
| D29,236 | S | 8/1898 | Walter | 76/15 |
| 2,971,806 | A | 2/1961 | Andreasen | 312/223 |
| 3,451,043 | A | 6/1969 | Krause | 340/152 |
| 3,573,739 | A | 4/1971 | Zeitlin | 340/172.5 |
| 3,648,241 | A | 3/1972 | Naito et al. | 340/147 R |

(Continued)

FOREIGN PATENT DOCUMENTS

| | | |
|---|---|---|
| GB | 1364535 | 8/1974 |

(Continued)

OTHER PUBLICATIONS

Memory-Based Identifier Tag Provides Digital ID- Dave Bursky—Electronic Design—Jul. 25, 1992—pp. 153 and 156.

(Continued)

*Primary Examiner*—Van T. Trieu
(74) *Attorney, Agent, or Firm*—Mark A. Tidwell, Esq.; Jackson Walker L.L.P.

(57) ABSTRACT

A system and method for tracking and controlling access to objects such as keys includes a lockable storage cabinet adapted to receive, store, and dispense objects within transparent security containers. A control computer is operably coupled to the cabinet. Information about objects, such as their weight, an image, or magnetic characteristics, is extracted by sensors when the objects within their containers are dispensed to a user or checked in by a user. This information is compared to a data base of the same information previously extracted for these objects. From the comparison, the connected control computer verifies that the objects present in the security container are the objects expected to be in the security container. If they are not, then theft or tampering is indicated and the computer takes remedial actions such as setting alarms or notifying security personnel.

45 Claims, 10 Drawing Sheets

U.S. PATENT DOCUMENTS 4,112,717 A 9/1978 Bradley ..... 70/63
4,267,942 A 5/1981 Wick, Jr. et al. ..... 221/2
4,419,734 A 12/1983 Wolfson et al. ..... 702/129
4,519,522 A 5/1985 McElwee ..... 221/13
4,549,170 A 10/1985 Serres et al. ..... 340/568
4,575,719 A 3/1986 Bertagna et al. ..... 340/825.35
4,595,922 A 6/1986 Cobb et al. ..... 340/825.49
4,635,053 A 1/1987 Banks et al. ..... 340/825.31
4,636,634 A 1/1987 Harper et al. ..... 250/223
4,636,950 A 1/1987 Caswell et al. ..... 705/28
4,661,806 A 4/1987 Peters et al. ..... 340/568.2
4,663,621 A 5/1987 Field et al. ..... 340/825.31
4,673,915 A 6/1987 Cobb ..... 340/330
4,737,910 A 4/1988 Kimbrow ..... 705/28
4,783,655 A 11/1988 Cobb et al. ..... 340/825.49
4,796,209 A 1/1989 Burk ..... 700/302
4,812,985 A 3/1989 Hambrick et al. ..... 364/478
4,814,592 A 3/1989 Bradt et al. ..... 235/381
4,839,875 A 6/1989 Kuriyama et al. ..... 369/14
4,845,492 A 7/1989 Cobb et al. ..... 340/825.49
4,866,661 A 9/1989 De Prins ..... 235/382
4,881,061 A 11/1989 Chambers ..... 340/572.1
4,885,571 A 12/1989 Pauley et al.
4,889,977 A 12/1989 Haydon ..... 235/375
4,896,024 A 1/1990 Morello et al.
4,918,432 A 4/1990 Pauley et al.
4,967,906 A 11/1990 Morello et al.
5,021,778 A 6/1991 Walton ..... 340/10.34
5,038,023 A 8/1991 Saliga ..... 235/385
5,099,227 A 3/1992 Geiszler et al. ..... 340/572
5,143,193 A * 9/1992 Geraci ..... 194/212
5,172,829 A 12/1992 Dellicker, Jr. ..... 221/13
5,182,570 A 1/1993 Nysen et al. ..... 343/795
5,287,414 A 2/1994 Foster ..... 382/1
5,434,775 A 7/1995 Sims et al. ..... 364/403
5,448,110 A 9/1995 Tuttle et al. ..... 257/723
5,510,770 A 4/1996 Rhoads ..... 340/572.3
5,528,222 A 6/1996 Moskowitz et al. ..... 340/572.7
5,554,974 A 9/1996 Brady et al. ..... 340/572
5,574,470 A 11/1996 De Vall ..... 343/895
5,612,683 A 3/1997 Trempala et al. ..... 340/5.23
5,635,693 A 6/1997 Benson et al. ..... 235/384
5,661,457 A 8/1997 Ghaffari et al. ..... 340/572.7
5,671,362 A 9/1997 Cowe et al. ..... 395/228
5,689,238 A 11/1997 Cannon, Jr. et al. ..... 340/572.1
5,703,785 A 12/1997 Bluemel et al. ..... 364/479.14
5,721,531 A 2/1998 Garver et al. ..... 340/825.49
5,739,765 A 4/1998 Stanfield et al. ..... 340/825.49
5,771,003 A 6/1998 Seymour ..... 340/568
5,777,884 A 7/1998 Belka et al. ..... 700/225
5,790,409 A 8/1998 McGrady et al. ..... 700/232
5,801,628 A 9/1998 Maloney ..... 340/568.2
5,805,074 A 9/1998 Warren et al.
5,836,002 A 11/1998 Morstein et al.
5,848,593 A 12/1998 McGrady et al. ..... 128/897
5,905,653 A 5/1999 Higham et al.
5,936,527 A 8/1999 Isaacman et al. ..... 340/572.1
5,957,372 A * 9/1999 Dean et al. ..... 232/43.1
5,961,036 A * 10/1999 Michael et al. ..... 232/43.1
5,963,134 A 10/1999 Bowers et al. ..... 340/572.1
5,971,593 A 10/1999 McGrady ..... 700/233
6,069,563 A 5/2000 Kadner et al.
6,073,834 A * 6/2000 Michael et al. ..... 232/43.1
6,075,441 A 6/2000 Maloney ..... 340/568.1
6,148,271 A 11/2000 Marinelli ..... 702/141
6,195,005 B1 2/2001 Maloney ..... 340/568.1
6,204,764 B1 3/2001 Maloney ..... 340/568.1
6,232,876 B1 5/2001 Maloney ..... 340/568.1
6,292,795 B1 9/2001 Peters et al.
6,431,438 B1 8/2002 Pires et al.
6,470,234 B1 * 10/2002 McGrady ..... 700/241
6,601,763 B1 8/2003 Hoch et al. ..... 235/385
6,707,381 B1 * 3/2004 Maloney ..... 340/568.1
6,745,366 B1 6/2004 Roh et al.
6,788,997 B1 * 9/2004 Frederick ..... 700/236
7,116,228 B1 * 10/2006 Singleton ..... 340/572.1

FOREIGN PATENT DOCUMENTS

WO WO 95/04324 2/1995
WO WO 95/12858 5/1995
WO WO 97/09687 3/1997
WO WO 00/16280 3/2000
WO WO 00/16281 3/2000
WO WO 00/16282 3/2000
WO WO 00/16284 3/2000
WO WO 00/16564 3/2000
WO WO 01/75811 10/2001

OTHER PUBLICATIONS

DALLAS Semiconductor—Application Note 106—Complex MicroLANs—Dallas Semiconductor Corporation—1995.
DALLAS Semiconductor—Application Note 104—Minimalist Temperature Control Demo—Dallas Semiconductor Corporation—1995.
DALLAS Semiconductor—DS2407—Dual Addressable Switch Plus 1K-Bit Memory—Dallas Semiconductor Corporation—1995.

* cited by examiner

OBJECT TRACKING METHOD AND SYSTEM WITH OBJECT IDENTIFICATION AND VERIFICATION

REFERENCE TO RELATED APPLICATION

This patent application is a continuation of U.S. patent application Ser. No. 10/180,665, filed on Jun. 26, 2002, now U.S. Pat. No. 6,707,381, which claims the benefit of priority of U.S. Provisional patent application Ser. No. 60/300,988, filed on Jun. 26, 2001.

TECHNICAL FIELD

This invention relates generally to object tracking and control methodologies and systems and more specifically to methods of tracking, controlling, identifying, verifying, and dispensing items such as keys, narcotics, pharmaceuticals, jewelry, and the like.

BACKGROUND

Many objects have intrinsic value or have value because they provide access to other valuable objects. For instance, jewelry and coins have inherent and intrinsic value, while keys, such as keys to vehicles, have value because they provide access to other valuable objects, namely automobiles and trucks. Access and control of either of these, that is intrinsically valuable objects or objects that provide access to intrinsically valuable objects, is an important need. Access to other types of items, such as narcotics and pharmaceuticals for example, needs to be monitored, tracked, and controlled to assure against unauthorized access and to assure that proper and appropriate access is catalogued and verified. There is a serious need to be able to track, catalogue access to, and control the dispensing of narcotics and similar items through methods and devices that are reliable, simple to operate, automated, and that guard against theft and mischief.

In the past, a variety of systems and methodologies have been developed and implemented to track and control various types of objects such as equipment, guns, vehicle keys, jail keys, etc. In the case of keys in an automobile dealership, for example, pegboards historically were used to keep track of keys as salespersons, maintenance personnel, and others removed keys for access to vehicles. Generally, sign-out sheets were used to log the check-in and check-out of the keys. Obviously, such a manual system of tracking has numerous shortcomings due in large part to the very real potential of human error and forgetfulness in carrying out the sign-in and sign-out procedures. More recently, automated computer controlled key tracking systems have been implemented for tracking, for example, vehicle keys at car lots and keys to the apartments of apartment complexes. Examples of such key tracking systems are disclosed in a variety of patents, including U.S. Pat. Nos. 5,801,628; 6,075,441; 6,195,005; and 6,317,044 of the present inventor, U.S. Pat. No. 4,812,985 of Hambrick et al. ("Hambrick"), U.S. Pat. No. 4,783,655 of Cobb ("Cobb"), and others. The disclosures of these patents are hereby incorporated by reference as if fully set forth herein.

While object tracking systems and methodologies disclosed in these and other references have proven extremely valuable in the tracking and control of objects such as keys, they nevertheless exhibit significant limitations and weaknesses in some applications. One primary weakness common to prior object tracking systems is that they don't track the actual objects that are being controlled, e.g. keys themselves. Rather, they track a container or tag that is attached to or carries the object and that is provided with an electronic or optical identification code. This opens the possibility for the object that is actually being tracked to be removed from its tag or container or swapped with a worthless object without the system identifying the security breach. For example, a key to a vehicle can be cut off of its ID tag or stripped from its container and a traditional electronic key tracking system will not detect the theft of the key. Similarly, if narcotics within ID containers are being tracked, the pills themselves can be removed from their containers and confiscated and the tracking system is none the wiser.

This problem has been addressed somewhat in key tracking systems such as that disclosed in U.S. Pat. No. 6,262,664 of the present inventor. In this system, keys are attached to their key tags with serialized tethers which, if cut, inform the system electronically of the breach. While this is an improvement in the tracking system, there still remains the possibility of removal of the key by cutting the physical key off of its tether, because this action would not alter the serial tether. In such a case, the only method of recognizing the theft is a physical inventory of the keys by a person. Requiring a human inventory in order to confirm that the key or other object being tracked and controlled is present by definition negates the main purpose of automatic key tracking systems. Essentially, the tracking system is reduced to a manual control system. It thus will be seen that as long as an object tracking system actually tracks and controls an attached tag or container and not the tracked objects themselves, dispensing and controlling items such as keys, jewelry, or narcotics is potentially not much better than a controlled honor system.

In the system of "Cobb," an attempt is made to address some of these shortcomings. In this system, an optional weighing scale is provided outside the system for the manual weighing of each object as it is checked in and checked out. The user is required to weigh an ID tag attached to tracked objects before it is inserted into the tracking system at check-in and just after it is received from the system at check-out to enter the weight manually into the control computer. The computer checks to make sure the weight is the same, theoretically confirming that the tracked item is intact and in place. In addition to reducing the Cobb tracking system to a manual honor system, there are other serious problems with this approach. For example, a key or other item being tracked can be removed during the period in-between removing its ID container from the system and weighing it on the scales. Returning the object can be even more prone to abuse. After the ID container and its contained object is weighed, the object, such as a key, can be removed before inserting the ID container into the tracking system. Such tempering can occur with an ID container or an ID tag. For example, a key can be precut to enable it to be removed easily after the tag is weighed. Cobb briefly and vaguely mentions a "weighing scale" but fails to teach any specifics regarding such scales or how they might be used to resolve the inherent problems discussed herein.

Thus, even though prior art key tracking and object tracking systems have proven very useful and have improved, there exists a continuing need for a system and methodology that addresses the above problems and shortcomings. In particular, there is a need for an object tracking system that automatically identifies and verifies the conditions of the tracked objects themselves as well as identifying the ID tags or containers to which they are attached or in which they are contained. A related need exists for a method of identifying and verifying that an item being tracked, such as a key, a piece of jewelry, or a unit of narcotics, is indeed present and genuine when being checked in and out of the tracking system. In the case of narcotics tracking, a need exists for an automatic tracking methodology that identifies narcotics and verifies upon check-in that only the proper number of pills or other units of the narcotic have been removed from their security containers while the narcotics were checked out of the tracking system. It is to the provision of an object tracking methodology and system that successfully addresses these and other important needs that the present invention is primarily directed.

SUMMARY OF THE INVENTION

Briefly described, the present invention, in a preferred embodiment thereof, comprises an improved method of tracking objects such as keys, jewelry, and narcotics that incorporates automatic identification and verification of the actual objects being tracked as the objects are checked out and checked back in at a central storage location. A system for carrying out the method of the invention is also proposed. In one embodiment, the system comprises a storage cabinet at the central location. The storage cabinet includes a portal for receiving and dispensing containers that contain the tracked objects, such as, for example, keys to automobiles. An internal array of storage bins are provided in the cabinet for receiving and holding the containers during the time that they are checked in. The bins may be arranged in a row and column array or may be formed around a rotating carousel. In any event, a container retrieval system in the cabinet is provided for retrieving a requested container from its bin and delivering it to the portal for retrieval by an authorized user. The retrieval system also moves a checked-in container from the portal, into which it is inserted when checked in, to a designated bin for storage.

A control computer is coupled to the retrieval system and includes a user interface, preferably on the outside of the cabinet. The computer controller can be located inside the cabinet if desired, or the computer controller and, indeed, the user interface as well can be located remotely from the cabinet. The user interface may include a keyboard and a display on the outside of or remote from the cabinet. The control computer is programmed among other functions to receive user identification and a user request for a particular object stored in the cabinet. If the user is authorized, the control computer directs the retrieval system to retrieve the security container bearing the requested object from its bin and deliver it to the portal, where it can be retrieved by the user. The control computer also receives instructions from the user that an object and its container is to be checked back in when the user has finished with the object. The user inserts the container into the portal, whereupon the control computer instructs the retrieval system to retrieve the object and move it to a designated bin for storage until it is requested again.

Each security container is provided with an identification code, which may be in the form of an optical bar code or an electronic code stored in a chip or RFID tag on the container. The system is provided with a reader, which may be an optical reader, a contact memory reader, or a radio frequency identification (RFID) reader, that reads the ID code of the security containers upon check-out and check-in to identify each container. In some respects, the system is similar to that disclosed in the Hambrick et al. patent. However, Hambrick et al. discloses only the reading of an optical bar code on an object container when the container is checked in to the system. No detection of the object itself is done and no reading at all is done upon check-out by a user. Thus, if a container drops from its storage bin or is taken from the storage cabinet after having been checked in, the Hambrick et al. system has no way to detect this event.

The system of the invention also includes elements within the cabinet for verifying that the correct object is actually contained within its designated container, both when the object is checked out and when it is checked back in. In a preferred embodiment, one such element include a scale in the cabinet coupled to the control computer. The scale is positioned adjacent the portal on the inside of the cabinet and a security container moves onto the scale temporarily during the check-out and check-in procedures. The control computer notes the weight of the container, which is the sum of the weight of the container and its contained object or objects, and compares this weight to a look-up table of expected weights for the various containers and their contents. If the weight matches the expected weight, then the control computer verifies that the correct objects are contained within the container and either dispenses the container to the user or stores it in a designated bin depending upon whether the object is being checked out or in. If a discrepancy is noted, the proper alarms are set and appropriate action, such as not dispensing the requested container or reporting to security personnel, is taken.

Where narcotics in the form, say, of pills are being dispensed, the control computer knows the weight of each pill and, when the narcotics container is checked back in after use, verifies by weight that the proper number of pills have been removed from the container. Thus, weight is one measurement used to carry out object identification and verification according to the method of the invention. It should be understood throughout this disclosure that whenever "pills" are used as an example of a form in which narcotics or pharmaceuticals can be made available, the term "pills" should be taken to include any other form or units that a narcotic might take. For example, units of a narcotic might be made available in the form of a liquid contained within a vial or ampule. The methodology of the present invention as disclosed herein applies to narcotics in these and other forms just as applies to narcotics in the form of pills. Pills are simply used in portions of this disclosure as convenient examples for purposes of discussion.

Another or second element of the system for carrying out object identification and verification functions is a digital imaging system in the cabinet coupled to the control computer. The containers that contain the objects being tracked are transparent or translucent so that the objects are visible in their containers. In one configuration, a digital camera is disposed above or below an imaging station in the cabinet, which may be the transparent platform of the scales, and a light is disposed on the opposite side or above or to the side of the imaging station. As a part of the check-out and check-in procedures, each container stops temporarily at the imaging station. The light is activated and the digital camera takes a digital image of the contents of the security container. The digital image is transferred to the control computer via, for instance, a "fire wire," USB, or other connection where it is subjected to a pattern recognition algorithm to extract predetermined features of objects within the security container. These features are compared to stored features of objects that are expected to be contained in the container. The control computer verifies that the features of the objects actually in the container matches the stored features of the objects expected to be in the container. If the features match, the control computer verifies that the correct objects are in the container and dispenses or stores the container as appropriate. If a discrepancy is noted, the control computer is programmed to take appropriate action such as notifying security personnel, creating a tamper log, sounding alarms, and/or refusing to dispense a requested container. In the case of narcotics, for example, the pattern recognition algorithm may determine from the digital image how many pills are present in the container and whether the remaining pills are the correct shape, size, and/or color. In this way, the control computer may determine, upon check-in, that only the correct number of pills were removed while the container was checked out and that the pills have not been substituted with different pills or otherwise tampered with.

Other elements may be provided for carrying out the object identification and verification functions of the methodology of this invention. For instance, a density or magnetic material detector may be employed to verify that the objects in the containers are made of the proper material (metal keys for instance). In any event, it will be understood that the method of this invention includes the steps of receiving a container bearing objects to be tracked, identifying the objects in the container, verifying that the objects are the objects that are expected to be in the container, and taking appropriate remedial action if a discrepancy is detected. The steps of identifying and verifying may include weighing the containers and their contents, comparing the weight to an expected weight, and noting a discrepancy if the weight is not what is expected. Identification and verification also may include imaging the objects in the containers, comparing the features of the imaged objects to stored features of objects expected to be in the container, and noting a discrepancy if the imaged objects are not as expected. Other means identification and verification also may be implemented.

Thus, an improved object tracking methodology is now provided that addresses and solves the problems and shortcomings of prior art systems and methodologies. In particular, the method of this invention includes not only identification of a container or tag attached to the objects being tracked, but actual identification and verification of the objects themselves. The likelihood of theft, substitution, manipulation, or other tampering is thereby reduced substantially as compared to prior art object tracking systems. These and other features, objects, and advantages of the invention will become more apparent upon review of the detailed description set forth below, when taken in conjunction with the accompanying drawing figures, which are briefly described as follows.

DETAILED DESCRIPTION OF THE PREFERRED EMBODIMENTS

Figure 1:
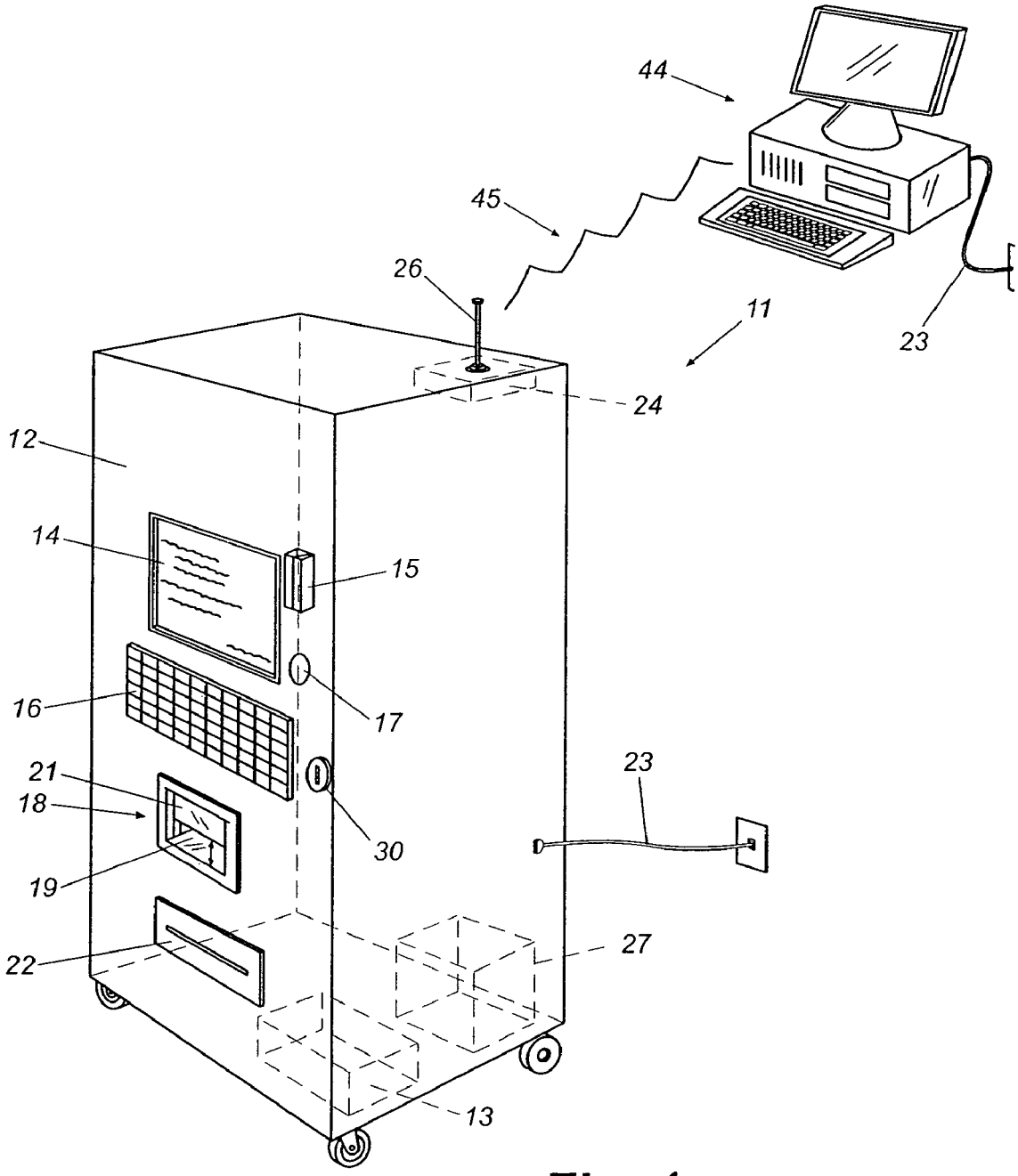
FIG. 1 is a perspective view of one possible embodiment of an object tracking and control system cabinet that embodies principles of the invention and that may be used to carry out the method of the invention.

Referring now to the drawing figures, in which like reference numerals refer to like parts throughout the several views, FIG. 1 illustrates one possible configuration of an object control system that may be used to carry out the method of the present invention. The system includes a secure lockable enclosure in the form of a cabinet 11 for containing the various components of the system and for storing and securing objects to be tracked and controlled. The cabinet is provided with a set of wheels or casters for moving the cabinet easily to a remote location, where the system may be operated in a mobile or stand-alone mode if desired. The cabinet has a front face 12 and contains, among other things, a control computer 13. The control computer 13 is provided with a user interface, which includes a display screen 14, a keyboard or keypad 16 for entry of information, a user identification reader 17, and a card swipe reader 15. The display screen 14 may take the form of a touch screen if desired so that users may enter information into the control computer by touching virtual buttons on the screen. The user identification reader 17 and card swipe reader 15 are provided for verifying the identity of a user. The reader 17 may comprise, for example, an ID fob reader, an RFID tag reader, or a biometrics detector such as a finger print reader, retina scanner, facial feature scanner, thermal imaging scanner, etc. The cabinet is provided with a lock 30 for securing the cabinet in its closed condition.

A portal 18 is disposed on the front face 12 for receiving and dispensing objects to be tracked and includes an opening 19 and a closable security door 21. Of course, a security door may not be needed or required for applications where security containers to be inserted into the system are small, in such cases, the portal is too small for a would-be thief to reach through the portal and security is therefore ensured by the small. In such cases, the portal is too small for a would-be thief to reach through the portal and security is therefore ensured by the small nature of the portal itself. The control computer 13 of the system also is provided with a network connection 23 for communication with other systems or with a central controller in a network of systems or with other computers such as inventory or billing computers.

Auxiliary or emergency communications capability is provided in the form of a wireless communications device 24, which may, for example, comprise a wireless local area network (LAN) device, and antenna 26, which are coupled to the control computer. Battery backup 27 is provided to insure operation of the system during power outages and during mobile or stand-alone operation. With regard to power outages, the control computer is programmed to alert security personnel via the network connection or wireless communications device if the power remains off long enough to threaten the integrity of the battery. In this way, security personnel are notified and advised to provide physical security for the system and/or to correct the power outage. The control computer may communicate with a remotely located central computer 44 either via the network connection 23 or the wireless LAN connection 45. In this way, a number of individual object control systems can be monitored by a central computer and information such as status, inventory, and billing information can be communicated through the network on a periodic basis.

Figure 2:
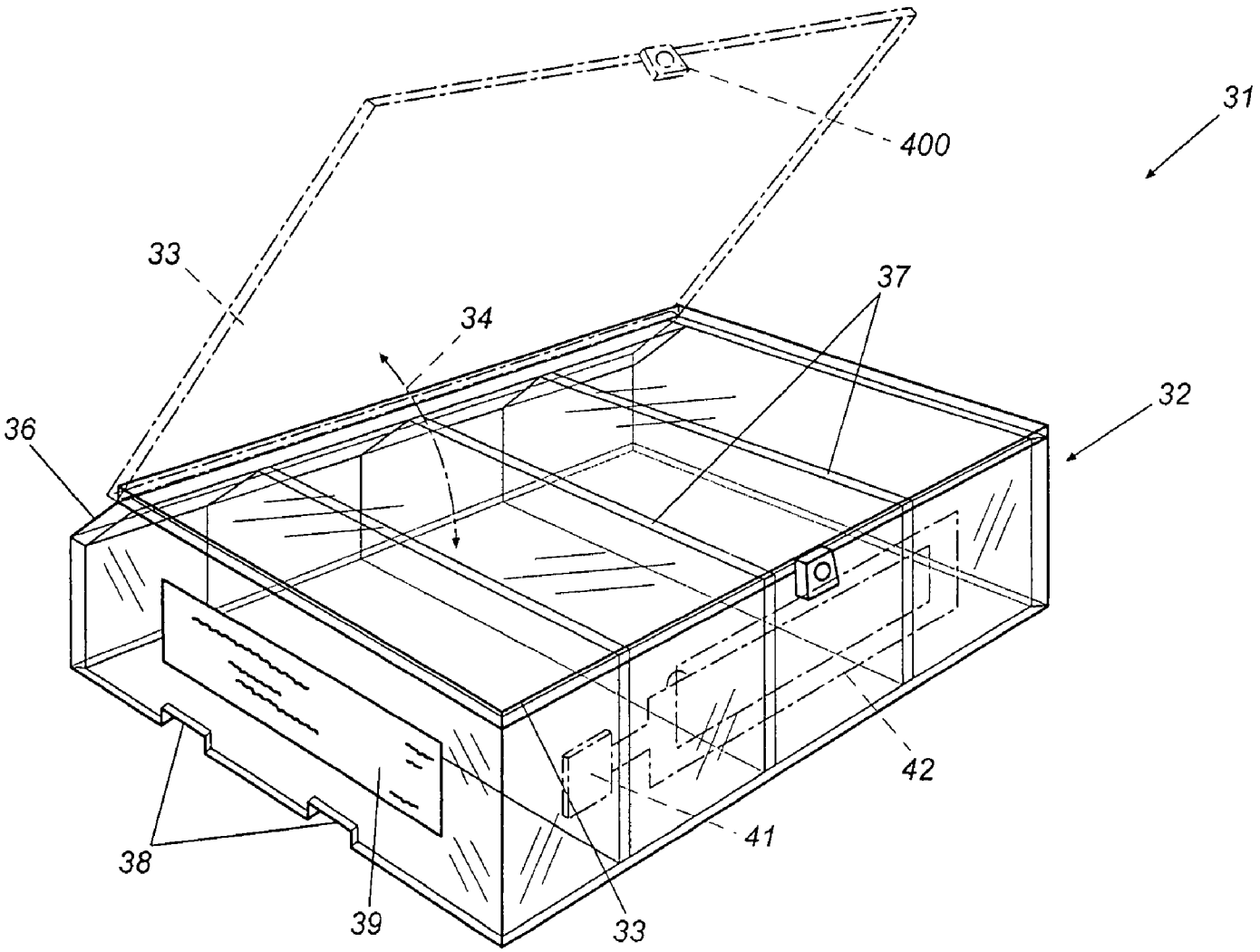
FIG. 2 is a perspective view of an security container configuration that may be used in carrying out the method of the invention.

The preferred system for carrying out the method of this invention is based upon security containers within which actual objects to be tracked are disposed during storage. FIG. 2 illustrates a possible configuration of a security container usable with this system. The security container 31 comprises a generally rectangular box 32 having an openable lid 33 for placing objects in the container and removing them from the container. The lid is openable and closable in the direction indicated by arrow 34 and preferably is provided with a latch 400 that keeps the lid securely closed until it is opened by a user. The container 32 in the embodiment of FIG. 2 has a chamfered or keyed edge 36 to insure that the container is inserted into the portal 18 (FIG. 1) in the proper orientation.

Partitions 37 preferably, but not necessarily, are provided in the security container and these partitions divide the interior of the container into a plurality of compartments within which objects to be tracked are disposed. A pair of spaced lift slots 38 are formed along the bottom of the box for receiving the forks of a lift mechanism within the cabinet, as described in more detail below. The lift slots 38 may be flared or tapered if desired to aid in positioning and centering the lift forks as they move into the slots. The lift forks also may be chamfered or otherwise contoured for this purpose. The container 31 may be provided with a label 39 bearing indicia identifying the contents of the container or conveying other desired information.

An RFID tag 41 and associated RF antenna 42 are provided on or embedded within a wall of the container so that the container can be identified by the system when checked in or out as detailed below. While an RFID tag is preferred for this purpose, container identification also may be provided in a variety of other ways such as, for example, via optical bar code, contact memory device, or otherwise. With respect to the operation of RFID tags and readers, reference is made to the disclosure of my U.S. Pat. No. 6,204,764, which is hereby incorporated by reference. The security container 31 preferably is made at least partially of a transparent or translucent material to provide for visual inspection of objects in the container and to facilitate the object identification and verification functions of the method of this invention, which are discussed in more detail below.

Figure 2A:
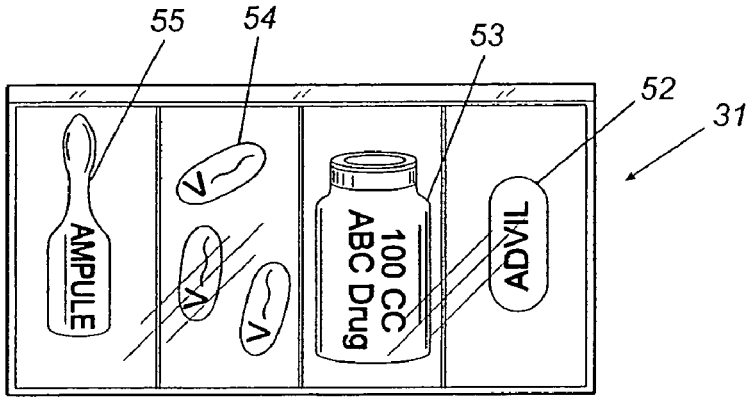
FIG. 2*a* is a top plan view of a security container according to the invention showing possible types and placement of narcotics or pharmaceuticals in the security container.
Figure 2B:
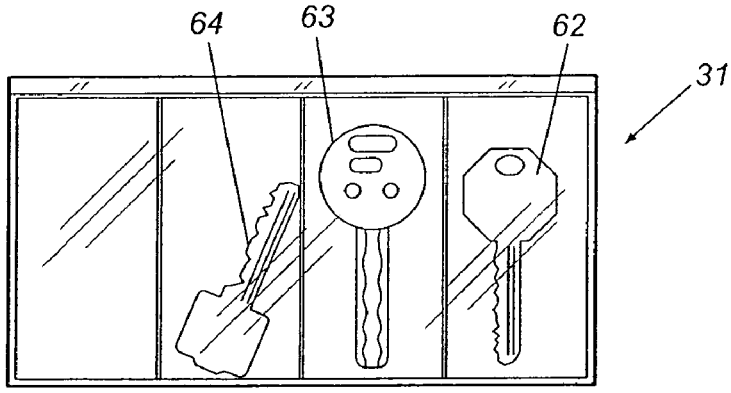
FIG. 2*b* is a top plan view of a security container according to the invention showing possible types and placement of keys in the security container.
Figure 2C:
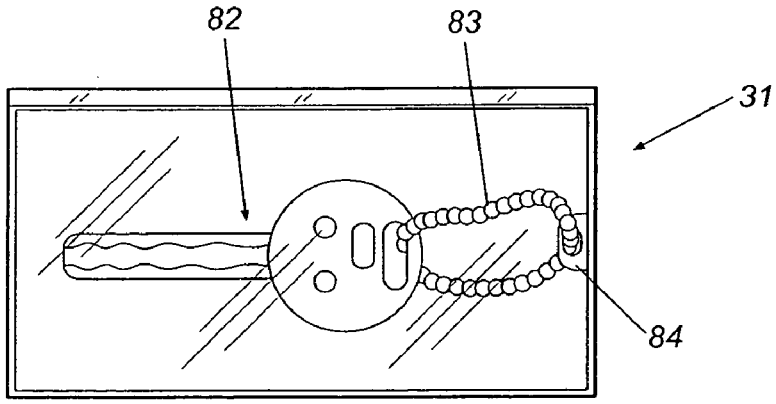
FIG. 2*c* is a top plan view of a security container according to the invention showing a key stored in the container and attached to the container with a tether.

FIGS. 2*a*-2*c* illustrate views of the security container 31 as seen from the top with various types of object to be tracked disposed in the container. FIG. 2*a* illustrates various pharmaceuticals in the security container including pills 52 and 54, a vial 53 containing a liquid medication, and an ampule 55. These items may be provided with indicia on labels or directly on the items that identifies the substance. As described in more detail below, these indicia may be "read" by the system using its digital imaging system and an optical character recognition (OCR) algorithm to identify the pharmaceuticals contained within the security container 31. FIG. 2B illustrates a number of keys disposed within the security container 31 including keys 62, 63, and 64. The keys preferably are arranged to lie flat in the security container. In this way, the key bits of the keys are visible and can be digitized from a digital image of the keys to identify the keys, as detailed below. Finally, FIG. 2C illustrates a key 82 within a security container with the key being tethered to the container by a tether 83 attached to the container by an attachment tab 84. The tethering of the key to the container provides certain advantages.

Figure 3:
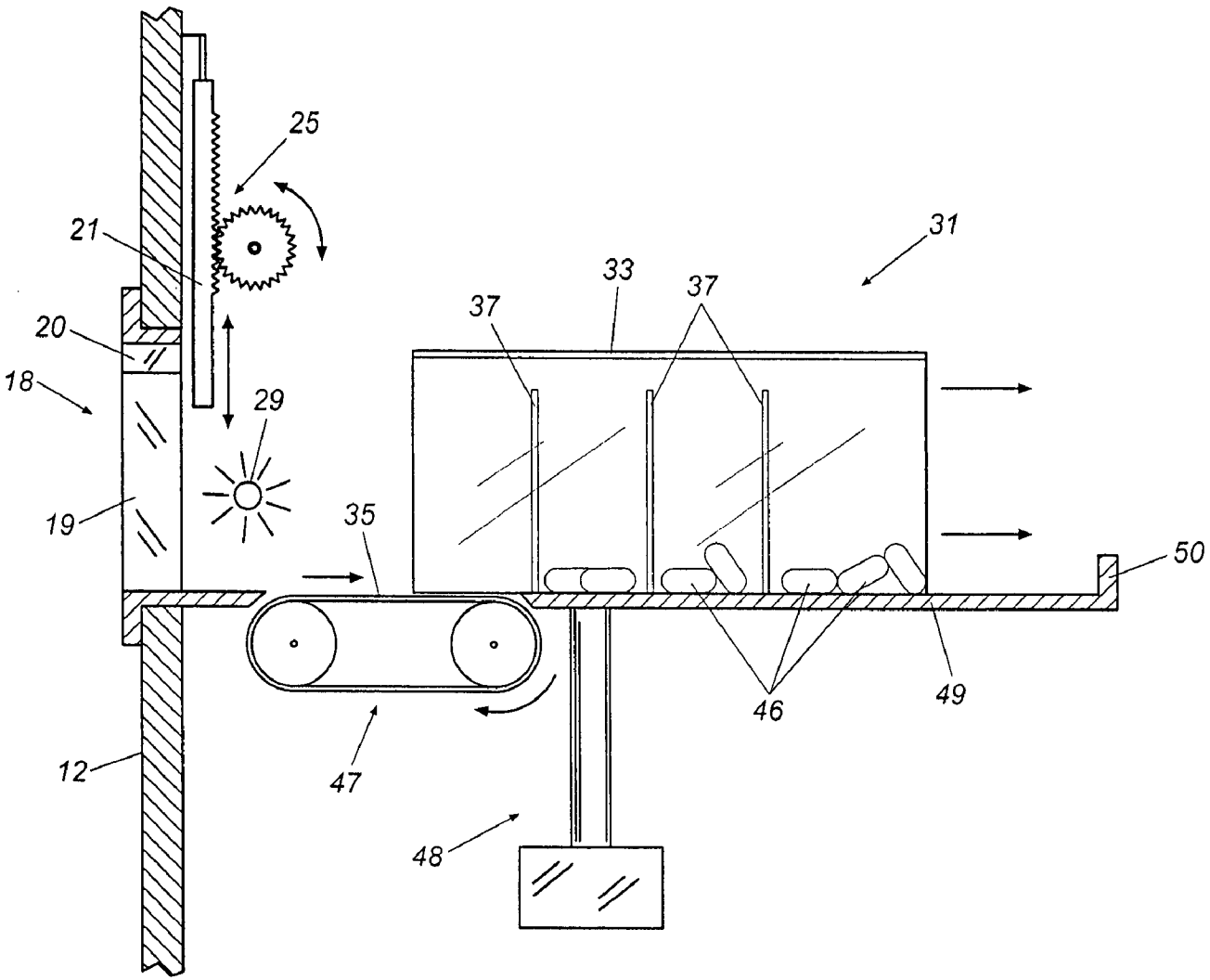
FIG. 3 is a side elevational view of the area of the cabinet of FIG. 1 inside its portal illustrating a possible scale configuration for carrying out the method of the invention.

FIG. 3 illustrates a possible mechanism for receiving and dispensing security containers through the portal 18 of the system. As mentioned above, portal 18 has a generally rectangular opening 19 formed with a keyed corner 20, which matches the keyed edge 36 of security containers. In this way, security containers can be inserted through the portal opening in only one direction. The openable security door 21 is opened and closed by a computer controlled servo-motor activated raising and lowering mechanism 25, which is coupled to and controlled by the control computer 13. A presence detector 29, which may be a simple optical interrupt detector, physical switch, or other appropriate device, is located just inside the portal for detecting that a security container has been inserted into the portal by a user and communicating this information to the control computer.

Figure 9:
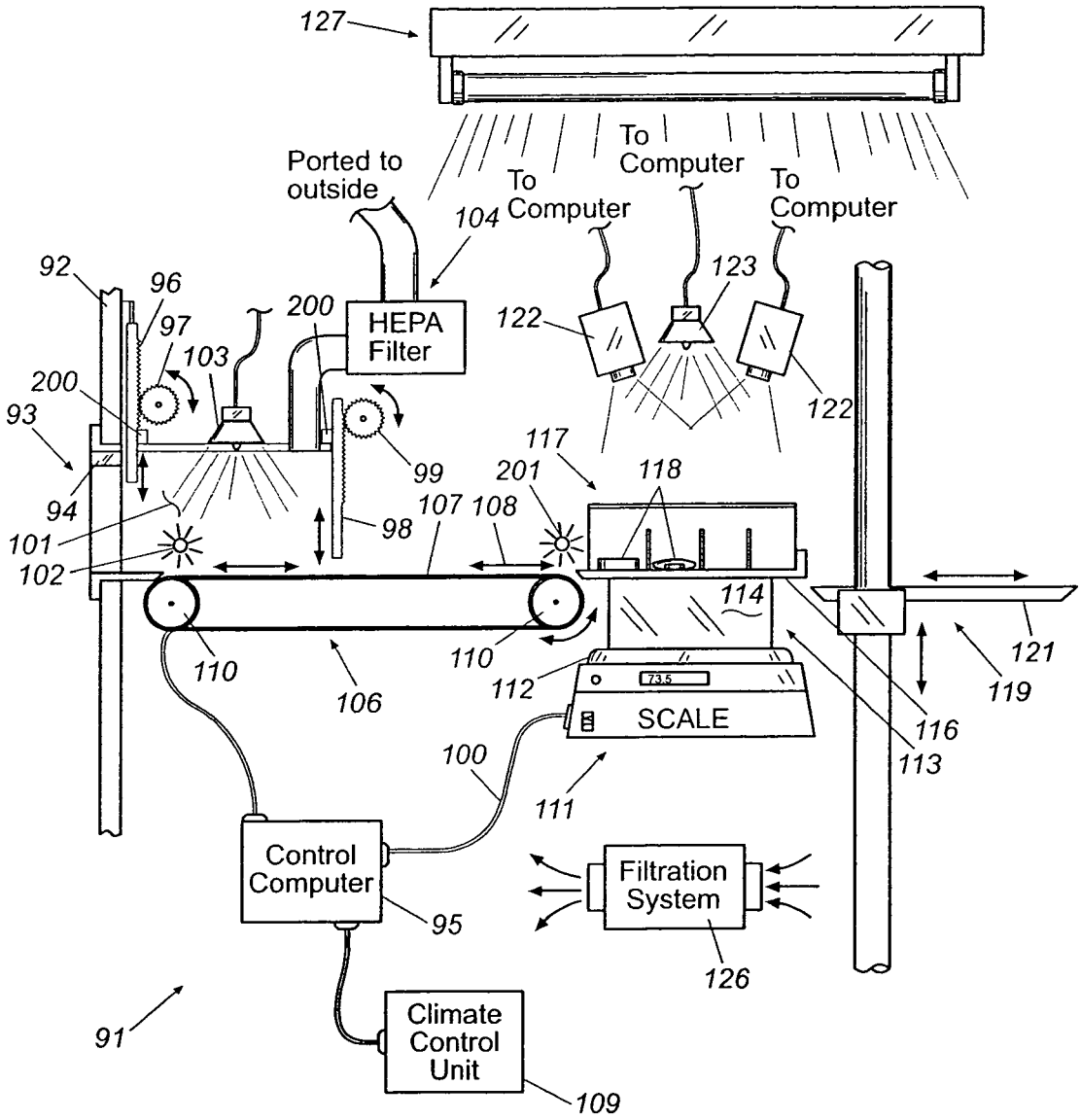
FIG. 9 is a side elevational component level view of an additional or alternate embodiment of components inside the cabinet for carrying out the method of the invention.

Although not shown in FIG. 3, but illustrated in FIG. 9, a second or inside security door and associated raising and lowering mechanism may be provided and positioned in the cabinet such that an antechamber sized to hold a container is formed between the two doors (see FIG. 9). In such a configuration, the control computer first opens the outside security door for receiving a security container and its contents into the antechamber. The outside security door is then closed before the inside security door is opened. In this way, enhanced security is provided, especially in the case of large security containers requiring a large portal opening, because a would-be thief is unable to reach into the cabinet through the portal door in an attempt to steel containers from the cabinet. Double doors also provided of a sealed cabinet in which the environment can be carefully controlled if desired.

A conveyor 47 is disposed in the cabinet just inside the portal and is also coupled to and operated by the control computer. The conveyor 47 has an upper flight 35 that moves to the right for receiving security containers into the cabinet or to the left for dispensing security containers from the cabinet, depending upon the direction that the servo activated sheaves of the conveyor are rotated by the control computer. FIG. 3 illustrates a security container 31 being received into the cabinet when the container and its contained objects are checked in to the system by a user.

An electronic digital scale 48 is disposed in the cabinet and the scale 48 has a scale platform 49 aligned with the upper flight 35 of the conveyor 47 in FIG. 3. As illustrated by the arrows when the security container 31 is inserted by a user into the portal 18, the control computer activates the conveyor 47 to move the security container to the right and onto the platform 49 of the scales 47. As discussed in more detail below with respect to the method of this invention, once the security container 31 is stationed on the scale platform 49, the control computer reads the weight of the container and its contents from the scale for object identification and verification processing. Digital scales suitable for use in the system illustrated herein are available from a variety of commercial sources, including Ohaus Scout and AdamLab. In FIG. 3, the security container 31 is seen to contain narcotics in the form of pills 47, illustrating one possible application of the method of this invention as a narcotics control and tracking system. It will be understood, however, that the objects could be keys, pieces of jewelry in a jewelry store, or any other type of object for which access is desired to be tracked and controlled.

Figure 4:
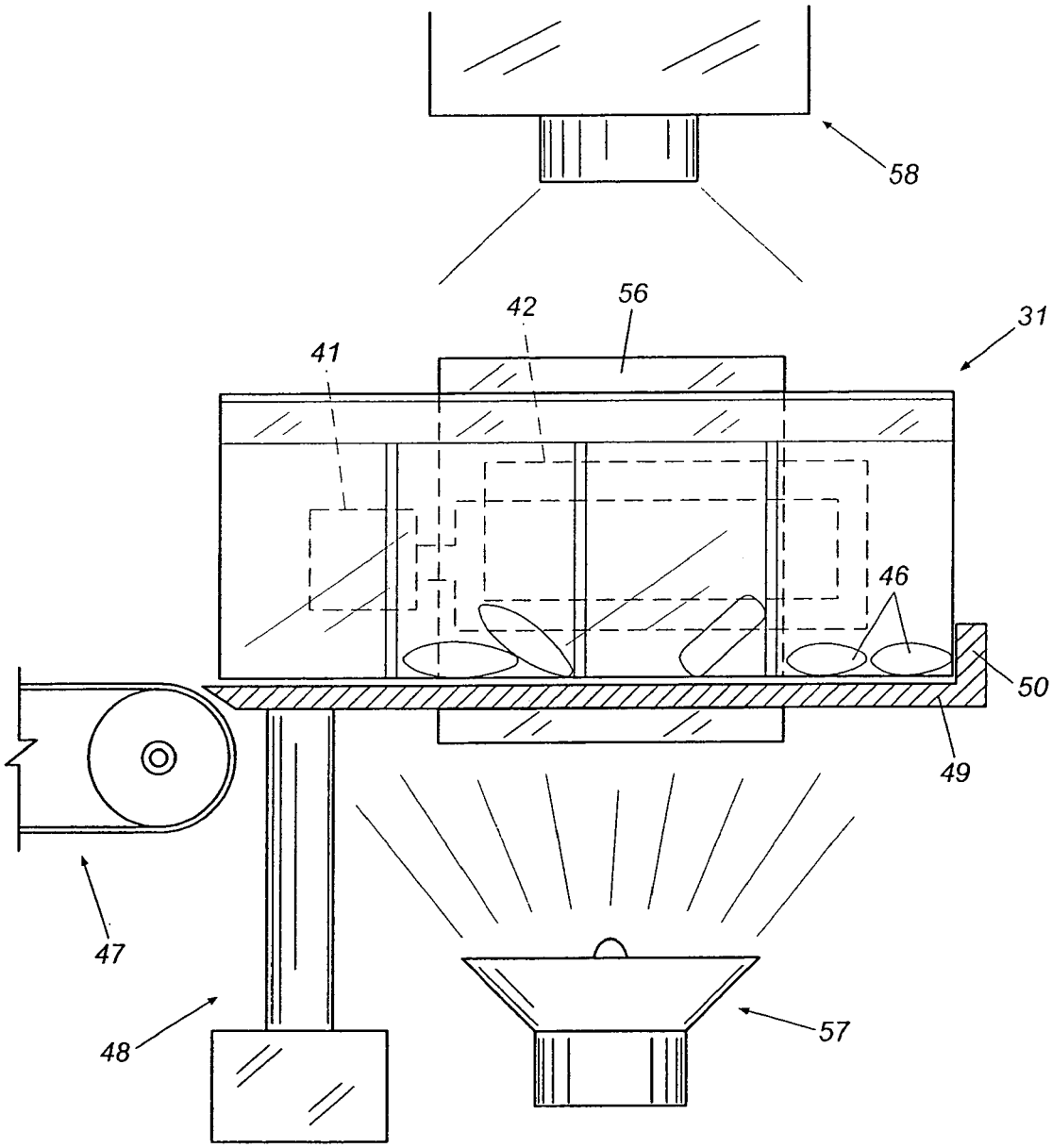
FIG. 4 is a side elevational view of the same area of the cabinet illustrating implementation of a digital imaging system according to the method of the invention.

FIG. 4 illustrates additional elements of the system for carrying out the method of this invention. Here, as in FIG. 3, a security container 31 is shown stationed on the platform 49 of the scales 48, where it is located just after check-in by a user or just before being dispensed to a user who has requested an object in the container. An RFID tag reader 56 is positioned in the cabinet beside the scale platform 49 and is adapted to read the unique ID code stored in the RFID tag by radio transmission, as described in the incorporated '764 patent. This ID code is communicated from the RFID reader to the control computer, which compares the code to a look-up table to identify positively the particular container stationed on the scale platform.

Also disposed in the cabinet is a digital imaging system comprising a digital camera 58, which may be located above the scale platform, and a light source 57, which may be located below the platform as illustrated or may be located to the side or above the platform. Of course, the camera and light source can be disposed at other locations relative to the platform if desired. The light 57 and digital camera 58 are coupled to and controlled by the control computer 13. As discussed in substantial detail below, when a security container 31 is positioned on the scale platform, which itself may be transparent or translucent, the control computer activates the light source 57 to illuminate the objects in the security container and instructs the digital camera to take a digital image of the objects. This digital image is conveyed to the control computer, which, through a pattern recognition algorithm, identifies the objects inside the security container and verifies that they are indeed the objects that are expected to be there. For example, the objects in the container in FIG. 4 are pills. In this case, the control computer may determine, for instance, the number of pills, their shapes, and colors from the digital image taken by the camera 58. This information is then compared to a previously created data base of the number, shapes, and colors of pills that are expected to be in this particular security container. If there is a discrepancy, the computer takes appropriate remedial action such as, for example, notifying security personnel and/or setting alarms. For purposes of digital imagery, the security container preferably is formed with a translucent or neutral colored opaque floor to ensure good digital images of only the objects in the security container.

Figure 5:
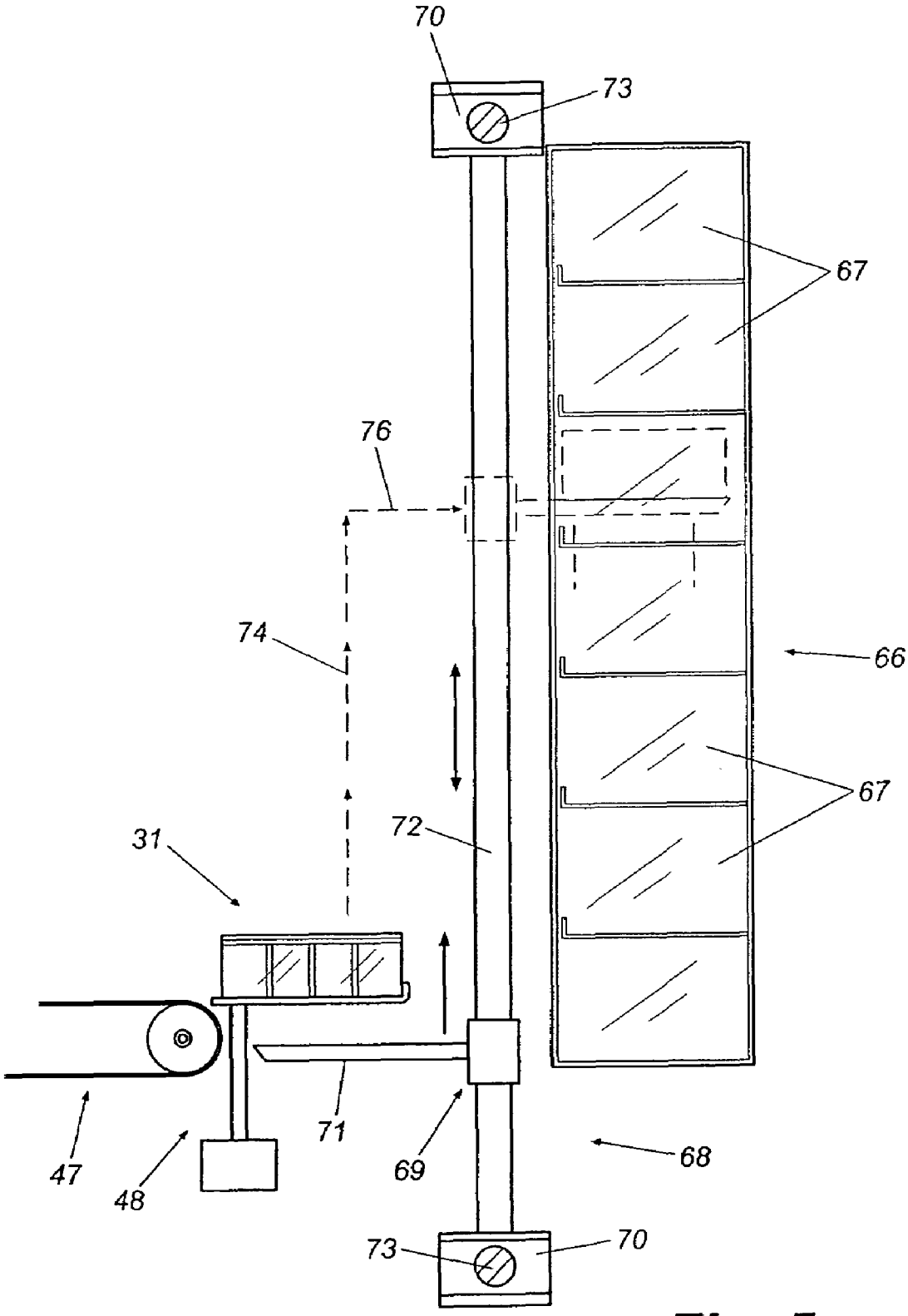
FIG. 5 is a side elevational view illustrating one possible configuration of a storage bin and retrieval system for carrying out the method of the invention.

FIG. 5 illustrates a possible container storage and retrieval mechanism within the cabinet 11 for storing a large number of security containers and for retrieving a requested container to be dispensed to a user. It should be understood that the illustrated storage and retrieval mechanism represents only one of a variety possible configurations and that other container storage and retrieval mechanisms may be equally applicable. For instance, the container storage system illustrated in the incorporated Hambrick et al. patent incorporates a carousel-based storage and retrieval mechanism, which may be preferred in some applications. In any event, referring again to FIG. 5, the storage and retrieval mechanism includes a storage bin array 66 comprising a two dimensional matrix of individual storage bins 67, each configured to receive and store a security container. A multi-axis lift assembly 68 is provided for moving security containers between the platform of the scale 48 and the individual bins in which they are stored. The lift assembly 68 is coupled to and controlled by the control computer 13 and includes a lift block 69 that is movable up and down along a vertical support 72. The vertical support 72, in turn, is horizontally movable (in and out of the page in FIG. 5) along a pair of horizontal supports 73, to which the ends of the vertical supports are mounted through slide blocks 70.

The lift block 69 and slide blocks 70 may be moved along their respective supports in a variety of ways such as, for example, through a cable system and associated computer controlled servo motors controlled by the control computer. In this respect, the lift assembly 68 may function in a manner similar to the pen transport system of a multi-axis plotter. Other methods such as, for instance, small computer controlled servo motors in the lift block and slide blocks having gears that engage teeth on the vertical and horizontal supports, may be implemented. The construction details of multi-axis lifts are known or available to those of skill in the art and need not be described in greater detail here.

The lift block 69 is provided with a pair of forks 71 sized and spaced to fit within the slots 38 (FIG. 2) along the bottom of the security containers for supporting the containers securely on the forks. The forks 71 are selectively movable to the left and right in FIG. 5, preferably by means of an appropriate servo motor and gear assembly within the lift block 69 coupled to the control computer 13. It will be seen that, with this configuration, the lift assembly 68 can be controlled by the control computer to move a security container back and forth between any bin of the storage bin array 66 and the platform of the scale 48. Movement of a container 31 from the platform to a storage bin is illustrated by arrows and phantom lines in FIG. 5. The lift system is controlled to move the forks 71 to a position beneath the security container 31, whereupon the lift block is raised until the security container rests on the forks. The lift assembly is then manipulated by the control computer to move the security container on the forks to the location of an empty bin of the array 66. With the container in this position, the fork servo motor is activated to move the forks and the security container supported thereon into the empty bin, as shown in phantom lines in FIG. 5. The lift block is then lowered, as indicated by arrows in FIG. 5, until the security container rests on the support rails of the bin. When the object in the stored security container is requested by a user and needs to be retrieved, this process is reversed to move the requested security container from its bin and onto the platform of the scales.

Figure 6:
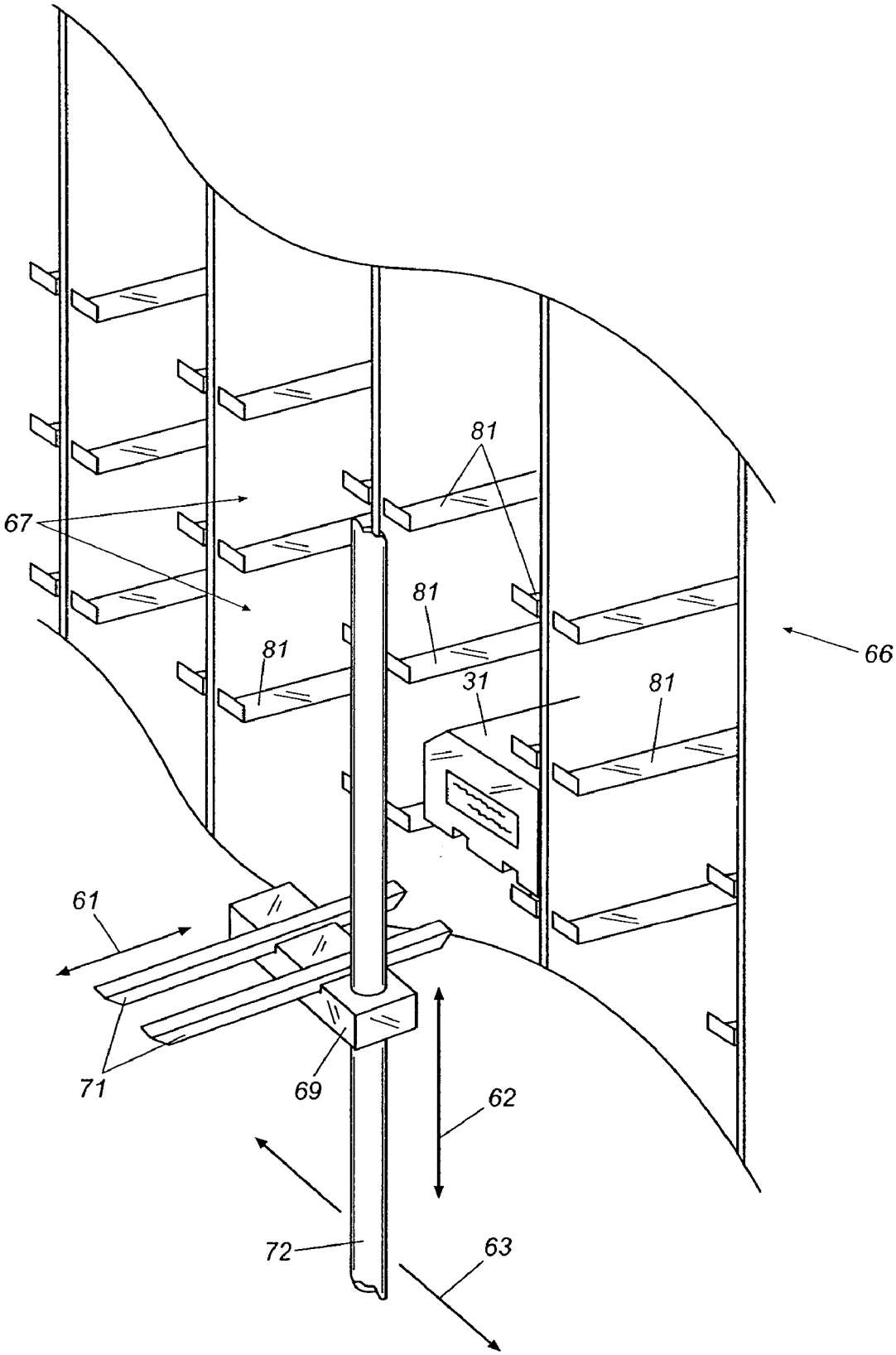
FIG. 6 is a perspective view of a portion of the storage bin array and retrieval system illustrating placement of the containers into and removal of containers from designated bins of the array.

FIG. 6 is a perspective view of a portion of the bin array 66 and a section of the lift system illustrating more clearly a possible configuration of the bins 67, lift block 69, and forks 71. Each bin of the bin array is seen to be defined by a pair of spaced apart support rails 81 on which a security container rests when present within the bin. The space between the support rails is greater than the space between the lift slots 38 of the security containers to allow the forks 71 of the lift system to move freely into the slots of the storage bins for retrieving or storing a security container. The lift block 69 is seen to have slots that accommodate the spaced forks 71 and within which the forks slide in the direction of arrow 61. As mentioned above, the lift block 69 moves along its vertical support 72 in the direction of arrow 62 and the vertical support 72 moves along the horizontal supports 73 in the direction of arrow 63. In this way, the forks can be positioned in front of any bin within the bin array 66 for storing or retrieving security containers.

As an alternative to the multi-axis and bin array storage system of the illustrated embodiment, a carrousel-based storage system might be used. A suitable carousel storage system is disclosed in the incorporated Hambrick et al. patent. There, the container lifting mechanism moves only in the vertical direction and the carousel, which has storage bins around its perimeter, rotates to bring the appropriate storage bin into alignment with a security container on the lift. These and other transport and storage mechanisms are possible. The particular configuration of the transport and storage mechanism is not limiting to the system and methodology of the invention so long as it is capable of moving security containers to and from storage locations and the scale platform 49.

Figure 7:
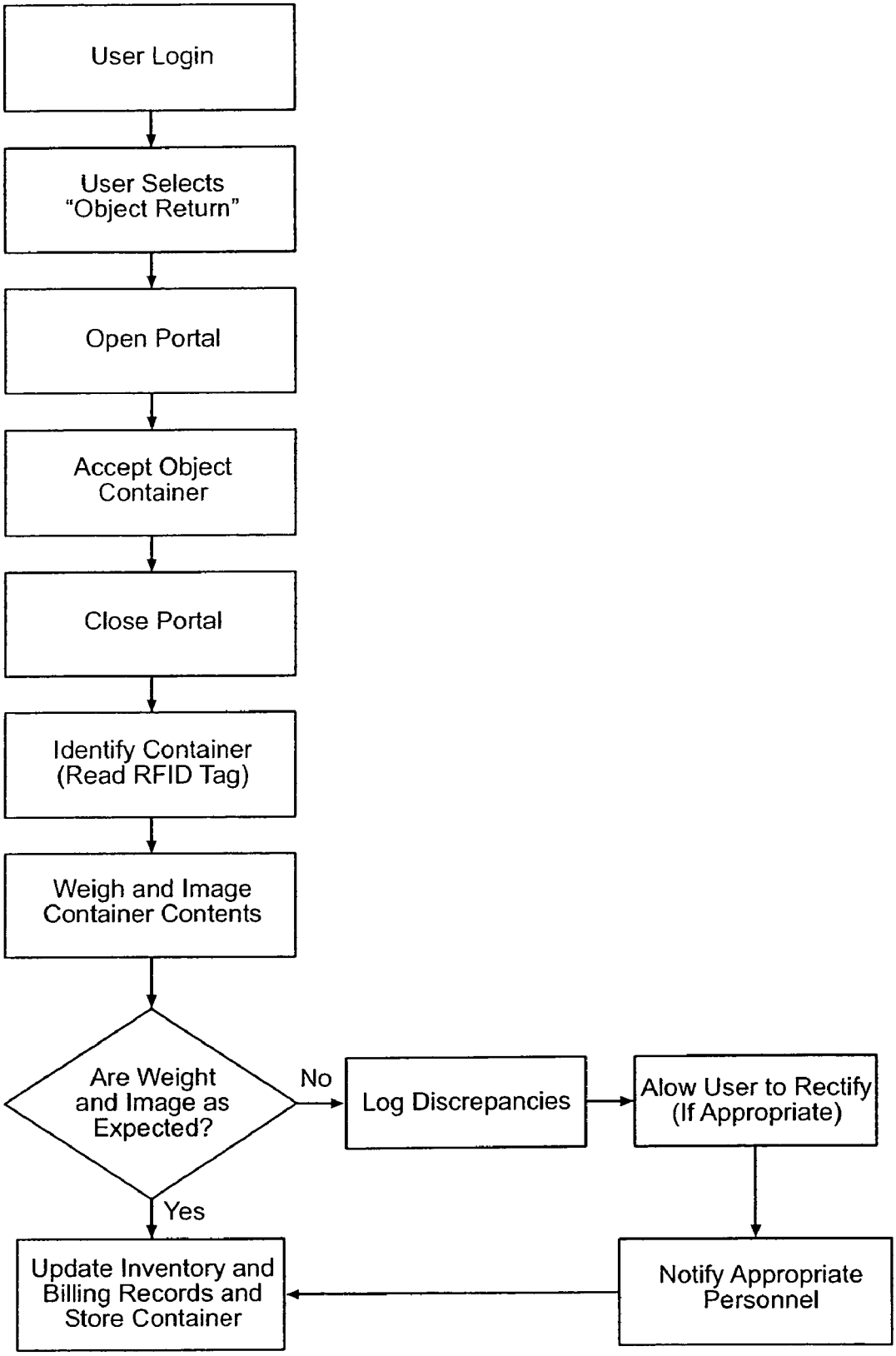
FIG. 7 is a functional flow chart illustrating a preferred embodiment of the check-in procedure of the invention.
Figure 8:
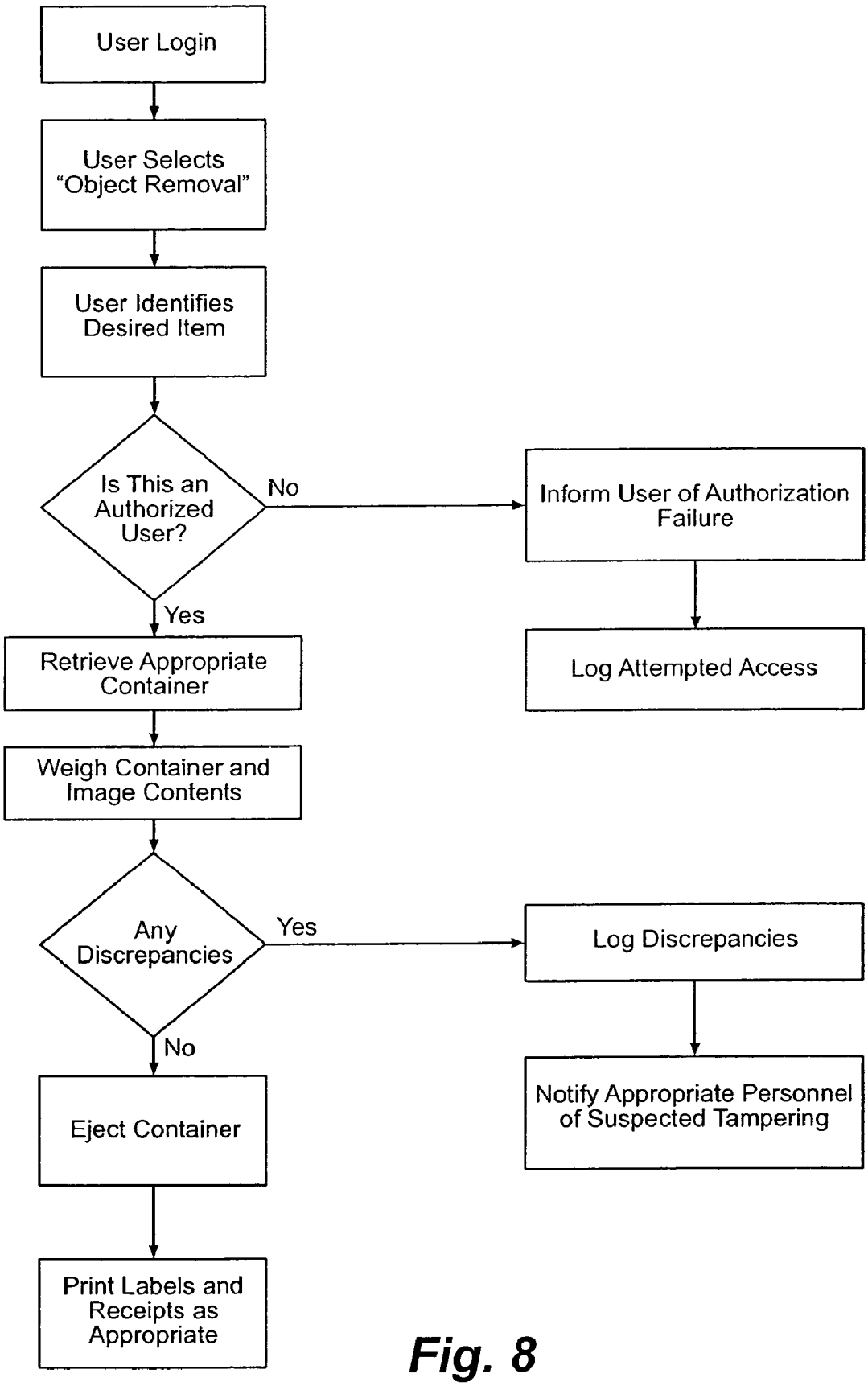
FIG. 8 is a functional flow chart illustrating a preferred embodiment of the check-out procedure of the invention.

FIGS. 7 and 8 illustrate the methodology of the present invention in the form of functional flow charts. FIG. 7 illustrates a preferred embodiment of the "login" procedure wherein a user checks back in to the system a security container and its contents that has previously been checked out from the system. Specifically, the user informs the system that he wishes to return an object by selecting the "object return" option. This may be done by selecting the object return option with the keyboard, by pressing a virtual button on the display screen, or otherwise. When the object return option is selected, the control computer raises the portal door to provide access to the portal opening and the user inserts the security container containing the tracked object into the portal. Upon insertion, the optical interrupt detector 29 (FIG. 3) or other presence detector informs the control computer that a security container has been inserted into the portal. The control computer then activates the conveyor inside the portal opening to draw the security container into the cabinet and position it on the platform of the scales, whereupon the portal door is closed and locked.

Once on the scale, the security container is interrogated. First, the RFID tag of the security container is interrogated with the RFID tag reader located adjacent the container to identify the security container itself. A table look-up is conducted by the control computer to log the container in and to determine various information about the container such as, for instance, the identity of the object or objects expected to be contained therein, the weight of the container and its contents at the time it was checked out, and the file location of the digital image of the container that was made when the container was checked out and/or the features derived therefrom. After determining such information about the container, the weight of the container and its contents is noted by the control computer by reading the digital scales on which the container sits. The scales communicate the weight of the security container to the control computer through a standard data communications protocol such as, for instance, through RS232 communications link. This weight is compared to the weight of the container as measured when the container was checked out of the system in order to confirm that the check-in weight is what it is expected to be. For example, where the container contains keys to vehicles, the measured weight should be equal to the weight noted at check-out. If it is not, then tampering, key substitution, a theft, or another inappropriate activity is indicated. In such a situation, the control computer is programmed to take appropriate remedial action such as logging the discrepancy, notifying appropriate personnel using the Internet or wireless connections of the system, and/or activating appropriate audio and/or visible alarms.

Alternatively, where the objects in the security container are narcotics in the form, for instance, of pills, then, in proper use, the user most likely will return the security container after having removed one or more pills from the container. In such a case, the difference in the check-out and check-in weight is compared by the control computer with the dosage requested by the user when the container was checked out. The difference should equal or correspond to the weight of the requested dosage. For instance, if 400 mg of the narcotic was requested, then the difference in weight should correspond to the weight of the pills containing 400 mg of narcotic. Any discrepancy in weight is noted to the user to allow immediate correction of any mistakes such as, for instance, an entry mistake in the requested dosage upon check-out. If a satisfactory correction is not entered, then tampering or theft is indicated and the discrepancy is logged and relayed to appropriate security personnel over the Internet or wireless connections. If the weight indicates that the proper number of pills have been taken from the container, then the control computer may communicate with a central billing and inventory computer via internet or wireless LAN connection to allow the central computer to update its inventory and patient billing records, whereupon the security container is stored until its contents again are requested by an authorized user.

When being used to dispense items such as narcotics in a hospital setting, the system of this invention also can be used as an inventory control and patient billing system as alluded to above. More specifically, since the control computer keeps track of how many pills remain in all of its security containers and how many are taken, by whom, and for what patient (this information can be entered by the user when requesting the narcotic), it can easily notify hospital pharmacy personnel through its network connection when a security container in the system has fewer than a minimum number of pills or other units of a narcotic. Pharmacy personnel can then restock the container. Further, the security computer can easily communicate through the network with the hospital billing system. In this way, narcotics requested and removed from the system for a patient are immediately and automatically billed to the patient's account upon check-in of a security container. These and similar useful functions may be apparent to those of skill in the art, and all should be considered to be within the scope of the invention claimed herein.

In addition to identifying the actual objects in the container by weight, the objects also preferably are identified and verified through visual inspection. This is accomplished using a digital camera and light, such as that shown in FIG. 4. The light is activated by the control computer, which illuminates the objects in the transparent or translucent topped container, and a digital image of the objects is taken with the digital camera. This digital image is transferred to the control computer where it is subjected to a pattern recognition algorithm to extract information from the image such as, for example, the number of objects in the container, their sizes, shapes, and colors. The compartments formed in the containers by the partitions help to keep the objects in the container separated to enhance the visual inspection by the digital camera.

In the case of objects such as keys lying in the security container as illustrated in FIGS. 2*b* and 2*c*, modern digitizing and pattern recognition algorithms can easily extract the unique key bit pattern of the key. This capability is enhanced if the keys are laid flat in the security container so that the digital camera can take a clear image of the edge or other machined portion of the key, but may be possible even if the keys are not laid flat. If a particular key bit pattern is not readable, the control computer may be programmed to eject the container and to display instructions to the user to re-arrange the keys and reinsert the security container in the portal. Since every key has a unique key bit pattern, the pattern extracted from the image is a unique identifier of the key or keys within the security container. The same concept can be applied to objects that are provided with printed labels such as, for instance, vials of liquid mediations. For such objects, Optical Character Recognition (OCR) techniques can be employed as part of the pattern recognition algorithm to "read" the labels and thereby to identify positively the vials or other objects present within security containers. For purposes of OCR and pattern recognition, the floor of the security container should be a uniform opaque color such as a "blue screen" blue to emphasize the shaped of objects in the container and to ensure that items underneath are not visible through the bottom of the container.

The information extracted from the digital image is compared with corresponding information extracted from a digital image taken of the objects in the container at the time it was checked out. If this comparison reveals that the extracted information about the objects is not what is expected, then tampering or fraud may be indicated. For example, a thief might check out a container with keys to valuable automobiles, take a key with intent to steal a vehicle, but replace it with a worthless key of the same weight in order to avoid detection through weight discrepancy. In such a case, the digital image identification and verification will detect that the replacement key has a different shape than the expected key. The would-be thief is foiled.

In the case of narcotics dispensing, the digital image at check-in might reveal that the shapes or colors of the pills checked back in do not match the shapes and colors of the pills in the container when it was checked out. This might indicate that the original pills have been substituted with other pills to fool the weight identification process. Alternately, the image might indicate that the number of pills remaining in the container at check-in is less than expected from the dosage requested at check-out. After the discrepancy is logged, the user may be given an opportunity to rectify the discrepancy. If satisfactory rectification is not forthcoming, an alarm condition is indicated and appropriate security personnel may be notified and alarms set. The offending container is then tagged in the control computer and stored for retrieval and inspection by security personnel.

FIG. 8 is a functional flow chart illustrating a preferred embodiment of the check-out procedures according to the method of the invention. After successfully logging in to the system by entering a user number or identifying himself or herself to the biometric detector, a user queries the system by requesting one of the secured objects. For example, if the object is a key to a particular vehicle, the user might enter the identity of the vehicle, whereupon the control computer identifies the key and determines which security container contains the requested key. If the requested object is a specific amount of a narcotic, then a security container holding at least the requested quantity of the narcotic is identified by the control computer.

The control computer then confirms that the individual requesting an object from the system is an authorized user that should have access to the requested item. If so, object retrieval continues. If not, the user is informed of the lack of authorization and the attempted access is logged for further investigation. Security personnel also can be notified if desired. If the user is authorized, the lift assembly is activated to retrieve the container containing the requested object from its storage bin and deliver it to the platform of the digital scales. There, the identity of the container is verified using the RFID reader and the security container is weighed and its contents imaged as described in some detail above. The weight and object information extracted from the image is compared to weight and object information from the last check-in of the container. Both should be the same or should be what is expected under the circumstances. If there is a discrepancy, then the contents of the container may have been tampered with while the container was stored in the cabinet. For instance, the cabinet may have been opened with a stolen access key, or forcibly, by a would-be thief and the objects taken directly from the container while it was stored in its bin. Or, the entire container may have been taken, which is revealed if the RFID reader detects no container on the scale. In any event, a discrepancy indicates an alarm condition and appropriate personnel are notified of the suspected tampering.

If the identification and verification of container contents indicates that the objects in the container are as expected, then the data bases in the control computer are updated with the new weight and the new digital image information. The security container is then moved from the scale platform onto the conveyor. This may be accomplished in a number of ways, all of which are equivalent and not limiting to the present invention. For example, in the embodiment illustrated in FIGS. 5 and 6, the container transport system 68 can be used to nudge security containers from the scale platform onto the conveyor. More specifically, when instructed by the control computer, the forks can be retracted, the lift block moved to the location adjacent the security container, and the forks extended to engage the security container and move it from the scale platform onto the conveyor.—The portal door is then opened and the conveyor activated to eject the security container from the portal for retrieval by the user. The status data base in the control computer is updated to reflect the fact that this user has now checked out the objects contained in the dispensed security container. If the user has selected a dispensable item such as a particular dosage of narcotics, then the system informs the user of the appropriate number of pills to remove from the security container. Preferably, the control computer also prints a label for attachment to the bag or pill bottle of the user to indicate the type and dosage of narcotics present in the bag. Additional labels, reports, and other documents also can be printed for hospital records. When the user has removed the proper number of pills from the security container, it is checked back in to the system for storage until next requested.

In addition to identifying and verifying the objects at check-in and check-out, the system of the present invention also is capable of carrying out the identification and verification process periodically on stored security containers for purposes of general system maintenance. For example, at user-selectable intervals of time, the system can sequentially use the multi-axis lift system to bring each security container from its storage location to the platform of the scale. The weight of the container is compared with the most recent weight as stored in the database. The digital imaging system is used to image the contents, and the number, size, shape, color, and/or other features of the objects in the containers is checked with the most recent values in the database. Any discrepancies indicate tampering, and the system can notify appropriate personnel.

This capability to re-verify stored objects periodically also is used whenever the cabinet is opened for any reason. After the cabinet is shut, the system automatically performs the verification and identification procedures as described above to insure that no items were removed or tampered with when the system was opened.

The system also is adapted for the logging in of new objects by a user. In a preferred methodology, empty unassigned security containers are stored in the cabinet and their location tracked by the control computer. When a user is authenticated and informs the system he wishes to log in a new object, the control computer may prompt the user for important descriptive information about the object such as, for instance, its nature, who is authorized to access it, how many are to be placed in the security container, what features of the object the control computer should use to identify the object (e.g. weight, key bit pattern, OCR, etc.), etc. The user then places the object or objects into the security container and inserts the container into the portal. The container is identified and appropriate information about the object is extracted such as, for instance, its weight, color, shape, key bit pattern etc. This information is then stored as the initial entry in the data base for the new object, and the information against which similar object information will be compared when the object is next checked out. The security container and object are then stored in a selected storage bin until subsequently requested by a user. This logging in new items procedure also can be used for "after hours drop off" by, for example, customers at an automotive service department. In such a case, the customer enters his name and other pertinent information, whereupon the system dispenses an empty security container in which the customer places his key. The container is then inserted in the system, where it is retrieved by service personnel when the service department opens.

In an enhanced embodiment, a single, larger RFID tag reader might be provided in the cabinet of the system. This RF tag reader may be programmed for continually monitoring and confirming that all security containers are still present inside the cabinet. In this way, if the system is compromised in some unforeseen way and any container is removed from the cabinet and thus from the RF tag reading zone, then the control computer notes the absence of the security container immediately and notifies appropriate personnel of the security breach. Appropriate alarms also may be sounded or set as required by the circumstances.

The network and wireless LAN communication capability of the present invention allows the system to be a component part of a central security system. In such a central system, each individual object control system is periodically queried by the central security system computer. The individual object control systems typically respond with a status report of some sort. If an object control system fails to respond, then the central security system may conclude that a potential breach in security has occurred and take appropriate action.

Thus, in view of the forgoing disclosure, it will be seen that the present invention, in its broadest form, comprises an improved method of tracking and controlling access to a plurality of objects. The method includes the steps of identifying the actual objects being tracked at check-out and check-in and verifying that the objects are in the condition in which they are expected to be. This identification and verification can be accomplished in a number of ways, including by weighing object containers and their objects and imaging the objects. In each case, the weight and image is compared to data bases of expected values, and discrepancies indicate foul play.

FIG. 9 illustrates another possible embodiment of an object control and tracking system for carrying out the methodology of the present invention. The components and various elements of this embodiment will be described first, followed by discussions of their applications and advantageous uses. Generally speaking, the system 91 in FIG. 9, which, it is understood, is disposed inside a cabinet such as the cabinet shown in FIG. 1, comprises a portal 93 disposed on the front face 92 of the cabinet. The portal opening is keyed at 94 as in the embodiment of FIG. 3 to ensure insertion of security containers into the opening in the proper orientation. An outside security door 96 is disposed at the mouth of the portal and is selectively openable and closeable by means of a computer controlled servo motor, represented by gear drive 97, that is coupled to the control computer 95. An inside security door 98 is inwardly spaced from the outside security door 96 and it too is selectively cpenable and closeable by means of a computer controlled servo motor, represented by gear drive 99. The outside and inside security doors 96 and 98, when closed, define an antechamber 101 sized to contain a security container bearing objects to be tracked by the system.

A presence detector 102 in the form, for example, of an optical interrupt detector or physical switch, is disposed in the antechamber and positioned to detect the presence of a security container within the antechamber. The resulting detection signal is conveyed via communications link to the control computer 95. The antechamber also may be provided with sterilization capability, which might be particularly useful when the system 91 is to be used to dispense, for example, biological specimens or other items that are sensitive to a contaminated environment. In FIG. 9, an ultraviolet anti-microbial lamp 103, such as a UV-C lamp available from the General Electric Company or Phillips Electronics, and a HEPA filter system is provided for decontaminating the antechamber and a security container located therein before the security container is moved from the antechamber and into the interior of the cabinet.

As in the embodiment of FIG. 3, a conveyor 106 is provided for conveying security containers to and from the antechamber. The conveyor 106 has an upper flight 107 that can be moved left or right as indicated by arrows 108 by means of computer controlled servo motors, represented in FIG. 9 by sheaves 110. The servo motors of the conveyor are coupled to and controlled by the control computer 95. A digital scale 111 is located adjacent the distal end of the conveyor 106. The digital scale 111, which is commercially available from sources such as Ohaus Scout or AdamLab corporations, is a precision scale that communicates with a host computer through a traditional communications link such as an RS232 link 100. In this way, the control computer 95 can determine the weight of an item atop the scale by appropriately reading the scale over its RS232 link. An optical interrupt or other presence detector 201 may be provided to confirm that a security container has moved from the conveyor onto the scales. The digital scale 111 has a bed 112 upon which a platform attachment 113 is mounted. The platform attachment 113 is configured to receive and support a security container 117 of the system so that it can be weighed, and to permit the forks 121 of the container transport system to move under the container for lifting and transporting the container. In this regard, the platform 113 may be provided with spaced apart support rails 116 similar to the rails of the storage bins in FIG. 6 to permit the forks of the transport system to be extended beneath the security container. It will thus be recognized that when a security container 117 and its contents, such as keys 118, are disposed on the platform attachment 113, their weight is measured by the scales 111 and transferred to the control computer 95.

A digital imaging system is provided in the embodiment of FIG. 9, just as such a system is shown in FIG. 4. However, in FIG. 9, the digital imaging system comprises a pair of spaced apart digital cameras for obtaining a stereo or three-dimensional image of objects contained within security containers disposed on the platform 113. Stereo imaging of the objects provides various advantages including the capability to form 3-D images and to measure distance and depth. A light source 123 for illuminating objects within security containers so that they can be imaged by the cameras 122 is disposed between the digital cameras 122 and is oriented to illuminate objects in security containers from above rather from below as in FIG. 4. In some applications, such illumination provides a more complete image of the objects, particularly when pattern recognition or OCR is used for object identification and verification or when the objects are being imaged in stereo. Finally, for applications where contamination sensitive objects, such as biological samples, are being stored in the system, decontamination systems are provided in the cabinet. In the embodiment of FIG. 9 these include and ultraviolet anti-microbial lamp 127 and an internal filtration system 126 for maintaining a sterile, dust free, and contamination free environment. A climate control unit 109 may be provided in the cabinet for maintaining a desired temperature, humidity, or other condition within the cabinet.

With the various elements and components of the embodiment of FIG. 9 described, a general discussion of applications and advantages will now be presented. One weakness of existing object tracking systems where objects are inserted into a portal in the system is that they rely on the small size of the outside entrance portal to prevent someone from reaching thru the portal in an attempt to tamper with the stored inventory. Because the entrance portal is small in these systems, the system is restricted only to storing small containers. To enable the secure storage of larger containers, a double door and antechamber arrangement as shown in FIG. 9 can be used. During container return, first the outer security door is opened and the inner security door is kept locked. After the object is detected by the control computer inside the antechamber, the outer security door is closed and then locked. Then the inner security door is unlocked, opened, and the object check-in procedure is is continued. More specifically, in the embodiment of FIG. 9, the conveyor 106 is activated by the control computer to move the security container and its contents out of the antechamber and onto the scale to be weighed and digitally photographed. With such a system, larger containers requiring a large portal can be stored securely without risk that a would-be thief can reach through the portal and abscond with items stored in the system. The ability to secure larger containers greatly expands the number of markets to which the system is applicable.

The presence of an antechamber also allows for some further improvements to the system. First, objects being returned can be exposed to strong UV light, such as UV-C or even UV-B or UV-A radiation, while inside the antechamber in their security containers. This UV radiation is generally lethal to bacteria and other microbes that might have contaminated the object while it was checked out of the system. Also, the cabinet itself can now be equipped to provide a controlled environmental chamber. A filtration system, containing a combination of carbon and HEPA filters along with internal UV lamps can be used to maintain a safe, microbe free environment inside the storage cabinet. Furthermore, the interior of the cabinet can be maintained at a positive pressure. The use of a positive pressure ensures that air flows out and not in through the entrance portal and through any leaks in the cabinet. The use of a positive pressure thus helps insure that the air inside the container is safe, filtered air and that contaminated air does not enter the cabinet during the check-out and check-in procedures. This safe, bacteria free environment could be highly desirable when dispensing objects in contamination sensitive applications, such as, for example, biological specimens in medical testing and pharmaceutical laboratories. The climate can be further controlled by inclusion of a climate control system, which may include, for instance, a heating and/or cooling unit, a humidity control unit, or otherwise. The cooling system can be conventional refrigeration and/or heating system. Another option is a solid state thermal electric system. The inclusion of climate control is beneficial in many markets that need to maintain objects in a temperature and/or humidity range. Envisioned markets include pharmaceuticals, rare art, jewelry, perishable goods, film, and the like.

The object lifting and placement apparatus inside the cabinet can be improved by using 'pick and placement' techniques. More specifically, a portion (for example, the bottom) of the security container can contain steel (or any magnetizeable material). The lifting arm can contain an electromagnetic coil that can be used to hold the box securely during lifting and placement. Because the electromagnetic attraction is formed by electric current flowing through a coil, the electromagnet can be conveniently turned on or off by simply turning the current on or off. An alternative enhancement to the container lift and placement mechanism is a vacuum system. The suction of the vacuum system would hold the box to the lifting arm, and the suction would be turned on/off at the proper times. The placement of a detector on the control arm would further improve the system. The detector could be a simple photo-optic sensor. The detector is used to confirm the actual pickup of a box or its presence in its designated storage location.

The utility of the secured, storage system and methodology of this invention can be further enhanced by enabling mobile use. A mobile system will operate at least temporarily off of the internal battery backup system (FIG. 1) and have wheels or casters. The battery allows the system to maintain continuous secure operation while unplugged. Also, the mobile system will maintain communication using RF Ethernet technology such as the RF LAN communications device illustrated in FIG. 1. This wireless connectivity allows remote billing and security monitoring during mobile operations. One envisioned use for the mobile system is drug storage/dispensing in a hospital. Clearly, many other applications also may exist and all are within the scope of the present invention.

The inclusion of a motion sensing apparatus will allow the system to track its movement. The motion sensing apparatus may include sensors to track wheel revolutions and/or accelerometers and/or a GPS satellite receiver coupled to the control computer. For example, the wheel sensors would enable the system to track lateral movement such as movement along hallways in a hospital. The accelerometers be used to track vertical movement such lifting or movement up and down in elevators. Such a motion enabled system would use these motion sensors to update its position continuously. If someone attempts to move the system to areas off limits, the system could notify security personnel and/or sound appropriate alarms.

Including an outside, magnetic card reader such as reader 15 in FIG. 1 can further enhance the utility of the system. The magnetic card reader would enable self dispensing; e.g., of medicines. For example, some college athletics programs track all medications taken by athletes. The system would keep track of all medicines dispensed to each athlete by identifying each athlete when the athlete's card was swiped, and could screen medicines according to individual sport rules and regulations. Another use could be in general prescription self dispensing. A customer could simply swipe his ID card and credit card on the magnetic reader and the system would dispense his prescription. This could be useful in after hours dispensing of prescriptions or even during busy store hours.

The security of the system can be enhanced by constructing the enclosure out of multiple armor plates (e.g. steel) and cement filler. One application would be storage of keys and weapons in a prison setting where a riot proof enclosure is required.

The invention has been described herein in terms of preferred embodiments and methodologies that represent the best mode known to the inventor of carrying out the invention. It will be understood by those of skill in the art, however, that many modifications and additions might be made to the illustrated embodiments within the bounds of the invention. For example, the object tracking and control method of this invention includes the steps of identification and verification of the actual objects being tracked. This is carried out in the preferred embodiment through two specific types of measurements; namely, weight and a digital image. However, other types of measurements might be selected and implemented by those of skill in the art, including, for instance, infrared, ultraviolet, or x-ray imaging, density measurements, sonar measurements, magnetic detection of ferrous objects, and the like. One specific alternate means for identifying and verifying the objects themselves that bears mentioning is to provide both the security containers and the objects in the containers, such as keys, with a readable identification code. A pair of code readers are then provided in the cabinet, one for reading the ID code associated with the security container and the other for reading the ID code on, in, or connected to objects contained within the container. In the preferred embodiment, the ID codes on both the container and object are stored in RFID tags read by RFID readers within the cabinet. However, the container or object or both may bear ID codes in a form other than an RFID tag such as, for instance, an optical bar code or contact memory device and appropriate readers may be provided as needed. In fact, a user can event write a code or other identification on the security container in handwriting and this can be imaged and translated through imagery and handwriting recognition algorithms. However, in the preferred embodiment with an RFID tag on the object, the object identification and verification processes are carried out through radio frequency detection of the identification code on the object itself rather than or in addition to through weight measurement or digital imagery. The ultimate goal to identify the actual objects in the containers and to verify that the identified objects are what they are expected to be is still met. It will be clear from the forgoing that the illustrated and preferred measurements herein are intended only as examples of how the identification and verification steps of the process might be carried out. They are not intended to be limiting and, indeed, any type of measurement from which object identification and/or verification can be derived is considered equivalent and within the scope of the present invention.

Potential additions or enhancements to the illustrated embodiments also are possible. Some of these are mentioned and discussed above. For example, the cabinet may be refrigerated when the system is to be used for dispensing heat sensitive objects, such as, for instance, certain medications, film, or biological specimens in a laboratory or hospital. A filtration system such as a HEPA filter also might be added where required for storage and dispensing of certain pharmaceuticals and other contamination sensitive items. In the illustrated embodiment, a pair of forks that fit within corresponding grooves in the bottoms of the security containers are illustrated for lifting and moving the containers. However, various other types of mechanisms also may be used in addition or as an alternative to the illustrated forks such as, for example, gripping jaws, vacuum pads, or electromagnetic pads that engage ferrous contacts on the containers. Indeed, the illustrated forks may be magnetizable with an electromagnet structure in the lift block and the grooves in the containers may be lined with a ferrous material. When the forks are moved into the grooves in such a system, they are magnetized to secure the container firmly on the forks. Clearly, where computer controlled servo motors are referenced in this disclosure, other types of drive mechanisms such as stepper motors controllable by a computer may be substituted and such substitutions are equivalent to the disclosed embodiments. These and many other additions, deletions, and modifications might well be made to the illustrated embodiments without departing from the spirit and scope of the invention as set forth in the claims.

What is claimed is:

1. A key tracking and control system comprising:

a. a storage unit defining an enclosed, internal space therein, said storage unit having a panel capable of being opened to access said internal space;

b. a plurality of receptacles defined within said enclosed, internal space, said receptacles disposed for receiving a plurality of trackable keys;

c. an access portal smaller than said panel;

c. a plurality of trackable keys removably insertable into said receptacles via said access portal without opening said storage unit panel wherein each trackable key is attached to a trackable RFID tag; and d. a central controller remotely located from said storage unit.

2. The system of claim 1, further comprising a communications link between said storage unit and said central controller.

3. The system of claim 2, wherein said communications link is a network connection.

4. The system of claim 3, wherein said network connection is the Internet.

5. The system of claim 3, wherein said network connection is a LAN.

6. The system of claim 2, wherein said communications link is a wireless connection.

7. The system of claim 6, wherein said communications link is a wireless LAN connection.

8. The system of claim 2, further comprising a plurality of storage units.

9. The system of claim 1, wherein said storage unit further comprises a local controller.

10. The system of claim 9, wherein said local controller is located in said storage unit.

11. The system of claim 9, wherein said local controller is remotely located from said storage unit and remotely located from said central controller.

12. The system of claim 9, wherein said local controller has a network connection.

13. The system of claim 9, wherein said storage unit further comprises a wireless communications device.

14. The system of claim 9, wherein said local controller is in communication with said central controller via the communications link.

15. The system of claim 9, wherein said central controller is a control computer.

16. The system of claim 15, wherein said local controller is a local computer.

17. The system of claim 1, wherein said storage unit comprises a storage cabinet.

18. The system of claim 1, wherein each of said trackable objects is associated with an asset to be tracked.

19. An object tracking and control system comprising:

a. a plurality of trackable objects, each trackable object having an upper portion and a lower portion;

b. a storage unit for receiving and storing said trackable objects, said storage unit having an array of sockets individually defined within the storage unit in the same plane, each socket configured to receive the lower portion of a trackable object;

c. said storage unit further having a local controller in electrical communication with said sockets;

d. a central computer remotely located from said storage unit; and e. a wireless communications link between said local controller and said central computer.

20. The system of claim 19, wherein said communications link is the Internet.

21. The system of claim 19, wherein said communications link is a LAN.

22. The system of claim 19, further comprising at least two storage units, wherein each of said storage units is remotely located from each other and from said central computer.

23. An object tracking and control system comprising:

one or more storage units for receiving a plurality of tangible objects detached from said storage unit, each storage unit having an array of adjacent sockets fixed relative to one another, each socket disposed to receive a detached tangible object; and a controller system coupled to the Internet, wherein the controller system stores information regarding receipt of a detached object seated in a socket or complete removal of a seated, detached object from a socket and allows the object tracking and control system to be accessed remotely via the Internet.

24. A key tracking and control system comprising:

a. a storage unit for receiving a plurality of trackable keys, said storage unit having a storage compartment defined inside the storage unit, said storage compartment having an array of adjacent, fixed slots disposed therein;

b. a plurality of detached, trackable keys removably insertable into said fixed slots of said internally defined storage compartment;

c. a central computer remotely located from said storage unit; and d. a communications link between said storage unit and said central computer, wherein said communications link is the Internet.

25. The system of claim 24, further comprising a security system in network communication with the central computer.

26. The system of claim 24, further comprising an inventory system in network communication with the central computer.

27. The system of claim 24, further comprising an accounting system in network communication with the central computer.

28. A method for managing objects, said method comprising the steps of a. providing a storage unit having an array of adjacent sockets fixed relative to one another defined within said storage unit;

b. providing a plurality of trackable objects, each object detachably seated within a socket;

c. providing a central controller remotely located from said storage unit;

d. linking the storage unit to the central controller via a network;

e. utilizing said central controller to remotely monitor transactions between the storage unit and detached, trackable objects; and f. authenticating a user before checking-out a particular trackable object;

g. checking-out the particular trackable object to the user;

h. authenticating the user before checking-in the particular trackable object; and i. checking-in the particular trackable object from the user.

29. The method of claim 28, further comprising the steps of a. providing at least two storage units, each with a plurality of trackable objects removably stored therein;

b. remotely locating said at least two storage units apart from one another;

c. linking each storage unit to the central controller via a network; and d. utilizing said central controller to aggregate information from each of said storage units.

30. The method of claim 28, further comprising the steps of a. providing a monitoring computer in communication with said central controller via a network; and b. transmitting information about the presence of trackable objects in a storage unit to the monitoring computer via the network.

31. The method of claim 30, wherein the step of transmitting comprises the step of transmitting an alarm to the monitoring computer based on the unauthorized removal of an object from a storage unit.

32. The method of claim 30, wherein the step of transmitting comprises the step of transmitting an alarm to the monitoring computer based on the unauthorized tampering of an object within the storage unit.

33. The method of claim 28, wherein the step of linking is accomplished using the Internet.

34. The method of claim 33, further comprising the step of communicating with the storage unit via the Internet.

35. The method of claim 33, further comprising the steps of a. providing an inventory system in network communication with the central computer; and b. transmitting trackable object inventory information from the central computer to the inventory system via the network.

36. The method of claim 35, wherein the step of transmitting via a network is accomplished using the Internet.

37. The method of claim 33, further comprising the steps of a. providing an accounting system in network communication with the central computer; and b. transmitting trackable object billing information from the central computer to the accounting system via the network.

38. The method of claim 33, further comprising the steps of a. providing a security system in network communication with the central computer; and b. transmitting trackable object security information from the central computer to the security system via the network.

39. The method of claim 33 further comprising the step of activating an alarm at the storage unit based on a monitored transaction.

40. The method of claim 28, wherein the step of linking is accomplished using a LAN.

41. The method of claim 28, wherein the step of linking is accomplished by a wireless communication link.

42. The method of claim 28, further comprising the step of transmitting an alarm from a storage unit to the central controller via the communications link based on unauthorized removal of an object from the storage unit.

43. The method of claim 28, further comprising the step of transmitting an alarm from a storage unit to the central controller via the communications link based on unauthorized tampering with an object associated with the storage unit.

44. The method of claim 28, further comprising the step of transmitting an alarm from a storage unit to the central controller via the communications link based on unauthorized tampering with the storage unit.

45. A method for managing objects, said method comprising the steps of a. providing an object tracking and control system with one or more storage units, each storage unit disposed for receiving a plurality of security boxes, each security box capable of containing a tangible object detached from said security box wherein each storage unit has an array of adjacent sockets fixed relative to one another, each socket disposed to receive one security box wherein each security box has an orientation feature so as to ensure that the security box is inserted into the storage unit in a proper orientation;

b. providing a controller system coupled to a communication medium;

c. storing information regarding receipt of a detached object seated in a socket or complete removal of a seated, detached object from a socket; and d. allowing the object tracking and control system to be accessed remotely via the communication medium.

* * * * *